US006377224B2

(12) United States Patent
Gomez-Henry et al.

(10) Patent No.: US 6,377,224 B2
(45) Date of Patent: Apr. 23, 2002

(54) DUAL BAND MICROWAVE RADIATING ELEMENT

(75) Inventors: Michel Gomez-Henry, Marcoussis; Gérard Caille, Tournefeuille, both of (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/836,334

(22) Filed: Apr. 18, 2001

(30) Foreign Application Priority Data

Apr. 20, 2000 (FR) ..... 00 05091

(51) Int. Cl.[7] ..... H01Q 13/10; H01Q 13/00
(52) U.S. Cl. ..... 343/772; 342/776; 342/786
(58) Field of Search ..... 343/776, 774, 343/756, 771, 772, 785, 786; 333/21 A, 135

(56) References Cited

U.S. PATENT DOCUMENTS 4,825,221 A 4/1989 Suzuki et al. ..... 343/785
4,998,113 A * 3/1991 Raghavan et al. ..... 343/776
5,066,959 A * 11/1991 Huder ..... 343/786
5,635,944 A 6/1997 Weinstein et al. ..... 343/776

FOREIGN PATENT DOCUMENTS

EP 0 403 894 A2 12/1990
EP 0 443 526 A1 8/2001
JP 51 147 155 12/1976

OTHER PUBLICATIONS

H. Z. Zhang et al.: "Characteristics of Quad–Ridged Coaxial Waveguides for Dual–Band Horn Applications" IEE Proceedings: Microwaves, Antennas and Propagation, GB, IEE, Stevenage, Herts, vol. 145, No. 3, Jun. 1998, pp. 225–228, XP000790391, ISSN: 1350–2417.

* cited by examiner

*Primary Examiner*—Tan Ho
(74) *Attorney, Agent, or Firm*—Sughrue Mion, PLLC

(57) ABSTRACT

A microwave radiating element including first and second means for conveying electromagnetic waves in respective first and second frequency bands, wherein the first and second means are coaxial.

7 Claims, 4 Drawing Sheets

DUAL BAND MICROWAVE RADIATING ELEMENT

The present invention relates to a radiating element operating in two separate bands or sub-bands with circular polarization, in the context of applications to radar or satellite telecommunications at microwave frequencies, for example.

BACKGROUND OF THE INVENTION

In telecommunications, this type of radiating element is more particularly intended to be integrated into an antenna on board a satellite or on the ground to enable communication between the various entities of the system.

Using different frequency bands or different ranges of frequencies in the same band, such as the 20/30 GHz Ka band, for example, necessitates the use of radiating devices capable of operating over a very wide band.

This necessity for a relatively wide frequency band is even more obvious when the radiating element must transmit and receive in two different frequency sub-bands.

In this case it is important for the frequency sub-bands to be relatively far apart to prevent the transmit and receive signals interfering with each other.

Prior art radiating devices operating over a relatively wide band are bulky and therefore costly to fabricate and complicated to use.

What is more, because of its structure, that type of wide-band device has a relatively limited surface efficiency.

It has been necessary to develop radiating elements operating in several bands or in several sub-bands of the same frequency band. This is known in the art.

For example, European Patent Application 0 130 111 discloses a radar source capable of emitting at least two frequencies so as to have high resolution at a high frequency and long range at a low frequency, for example.

The radar source employs four waveguides surrounding a fifth waveguide.

The four peripheral waveguides operate in the Ku band centered on 16 GHz and the central waveguide operates in the X band centered on 10 GHz, for example.

However, that kind of device operates only with linear polarization, and circular polarization necessitates the addition of a hybrid coupler, which increases the size and cost of the device. Moreover, high-frequency hybrid couplers cause high losses in the circuit.

The above kind of prior art device also necessitates a bulky and complex feeder system to radiate correctly, which makes the overall size even larger and the cost even higher.

What is more, an antenna including the above kind of source is intended to operate with a ratio of 6 or more between the highest and lowest frequencies, which does not impose severe operating constraints because of the separation of the highest and lowest frequencies.

However, with a ratio between the highest and lowest frequencies in the range from 1.22 to 2, the above kind of antenna is not efficient because of interaction between the various parts of the antenna.

So-called "plane" antennas employing integrated circuits and requiring no hybrid coupler are known in the art, in particular from French patent application 98 06200. However, plane antennas with a frequency ratio in the range from 1.2 to 2 are subject to high losses due to coupling of the elements operating in the high and low bands, in particular because of their compact size.

OBJECTS AND SUMMARY OF THE INVENTION

Against the above background, an object of the present invention is to alleviate the above drawbacks by proposing a compact low-loss dual band microwave radiating element and generating the circular polarization by means of the radiating part of the antenna itself, without requiring any additional circuit such as a hybrid coupler, for example.

To this end, in a microwave radiating element of the invention and including first and second means adapted to convey electromagnetic waves in respective first and second frequency bands, the first and second means are coaxial and the first means include a hollow metal waveguide adapted to receive the second means coaxially.

In a first embodiment the second means also include a hollow metal waveguide.

In a second embodiment the second means include a waveguide comprising a dielectric material core and a dielectric material covering and said dielectric waveguide is a microwave fiber which propagates only the H11 hybrid mode, for example.

In the first embodiment, the waveguides constituting the first and second means advantageously terminate in respective polarizers, the polarizers are interleaved one within the other and the geometry of the polarizers is such that electromagnetic waves are circularly polarized.

The polarizers are preferably of rectangular or elliptical cross-section.

In a preferred form of the second embodiment of the radiating element of the invention the geometry of the dielectric waveguide is such that electromagnetic waves are circularly polarized.

The core of the dielectric waveguide preferably includes an extension emerging from the covering of said waveguide and having elliptical, rectangular, or ellipsoidal cross-section.

BRIEF DESCRIPTION OF THE DRAWINGS

The invention will be better understood in the light of the following description, which relates to an illustrative and non-limiting example and is given with reference to the accompanying drawings, in which.

MORE DETAILED DESCRIPTION

Figure 1:
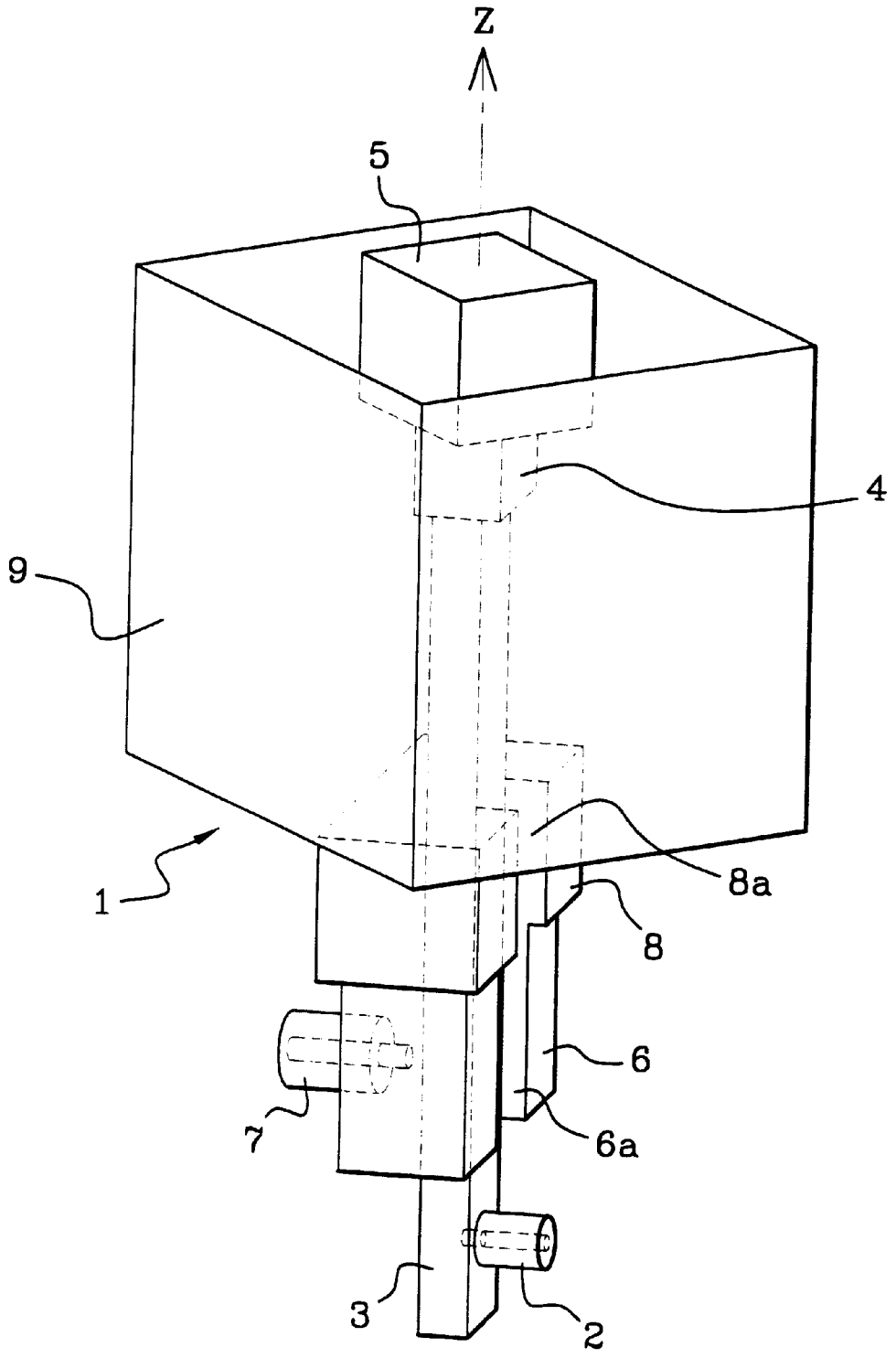
FIG. 1 is a diagrammatic perspective view of a first embodiment of a radiating element according to the invention.

FIG. 1 is a diagrammatic perspective view of a first embodiment of a radiating element 1 according to the invention.

The radiating element 1 includes a first excitation port 2 generating the wave to be propagated. In the FIG. 1 embodiment the excitation port 2 is a coaxial port including a tubular peripheral part 2*a* and a cylindrical central part 2*b* at the center of the peripheral part 2*a* (see FIGS. 2 and 3).

Note that the excitation port 2 could use any other excitation technique known in the art, such as the stripline technique, for example, or consist of another waveguide.

The excitation port 2 is connected by the central part 2*b* and in a manner known in the art to a first end of a first feeder waveguide 3 adapted to operate in the Ka band at a frequency of around 30 GHz, to be more precise at a frequency in the 27.6 GHz to 29 GHz range, for example.

The feeder waveguide 3 (hereinafter referred to as the waveguide 3) is perpendicular to the excitation port 2 and takes the form of a hollow elongate duct which has a longitudinal axis Z and a rectangular cross-section. It propagates linearly polarized electromagnetic waves.

At the end opposite the excitation port 2 the waveguide 3 includes a transition section made up of a matching transformer 4 which is aligned with it along the axis Z of the waveguide 3.

The matching transformer 4 consists of a hollow waveguide having a cross-section of identical shape to that of the waveguide 3 but with larger dimensions, except for its longitudinal dimension parallel to the axis Z.

The waveguide 3 is centered on and aligned with the matching transformer 4, with the various faces of the waveguide 3 and the matching transformer 4 parallel to each other.

A hollow parallelepiped-shaped rectangular cross-section polarizer 5 operating at 30 GHz and having dimensions greater than those of the matching transformer 4 is aligned with the matching transformer 4.

To generate circular polarization of the signal, the polarizer 5 is offset angularly by 45° about the axis Z relative to the matching transformer 4, which is aligned with the waveguide 3.

To obtain circular polarization of the signal, the polarizer 5, although of rectangular section as shown here, could equally well be elliptical.

The above three components, i.e. the waveguide 3, the matching transformer 4 and the polarizer 5, are made of metal, for example, and are assembled together end-to-end at one of their faces by any technique known in the art, such as welding, machining or spark erosion, or are molded.

Figure 2:
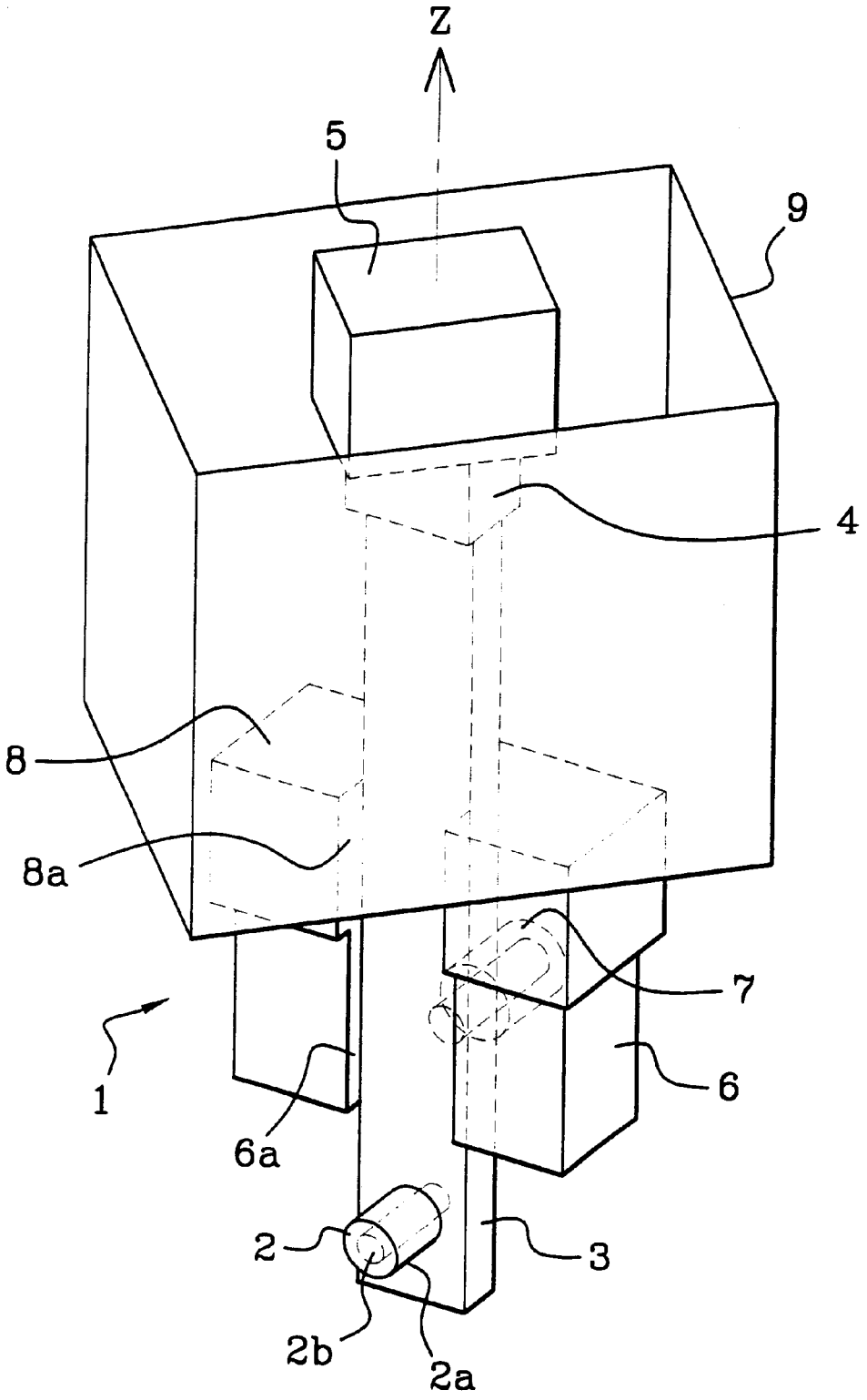
FIG. 2 is a diagrammatic perspective view of the radiating element shown in FIG. 1 seen from a different angle.
Figure 3:
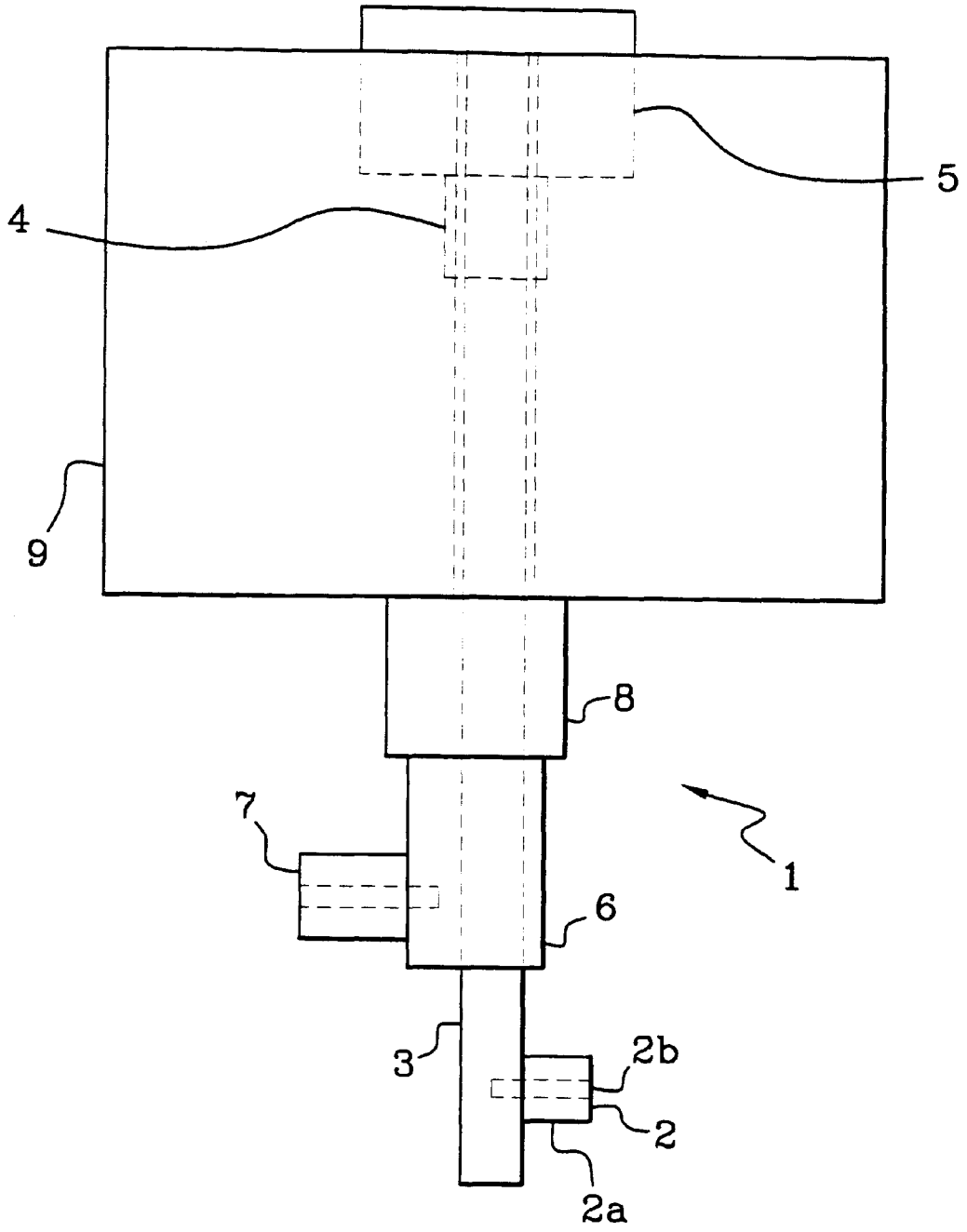
FIG. 3 is a side view of the radiating element shown in FIG. 1.

Note further that several transition sections such as the matching transformer 4 can be provided between the waveguide 3 and the polarizer 5 in the embodiment shown in FIGS. 1 to 3.

The first waveguide 3 is disposed coaxially inside a hollow second feeder waveguide 6 which is of substantially rectangular cross-section but whose dimensions are greater than those of the first waveguide 3. The respective faces of the waveguides 3 and 6 are parallel to each other.

The second waveguide 6 has a small inward step on one of its larger faces forming a rectangular section groove 6*a* parallel to the axis Z of the waveguide 3.

A groove like the groove 6*a,* which is also referred to as a "ridge", restricts to the fundamental mode propagation of electromagnetic waves by the waveguide including the groove.

A waveguide including the above kind of ridge 6*a* is referred to as a ridged waveguide.

The second waveguide 6, which is shorter than the first waveguide 3 in the direction parallel to the axis Z, is associated with a coaxial second excitation port 7. Any technique other than the coaxial technique is also feasible.

The second waveguide 6 also operates in the Ka band at a frequency of about 20 GHz, for example a frequency in the 17.8 GHz to 19.2 GHz range.

The first waveguide 3 is fastened to the second waveguide 6 at the ridge 6*a,* the width of said ridge 6*a* corresponding to the width of the first waveguide 3.

A transition section in the form of a matching transformer 8 is aligned with the second feeder waveguide 6.

The matching transformer 8 is a ridged waveguide including a ridge 8*a* whose cross-section is the same shape as that of the second feeder waveguide 6 but whose dimensions are larger.

The ridges 6*a* and 8*a* are therefore aligned and parallel to the axis Z of the first waveguide 3.

The matching transformer 8 is associated with a polarizer 9 on the side opposite the second waveguide 6.

The polarizer 9 has a substantially rectangular cross-section with sufficiently large dimensions to contain at least part of the higher band polarizer 5.

Like the polarizer 5, the polarizer 9 is offset angularly by 45° about the Z axis relative to the matching transformer 8 and the waveguide 6 to generate circular polarization of the signal.

To generate circular polarization from the linear polarization of signals propagating in the waveguide 6 and the matching transformer 8 the polarizer 9 can take a different form, for example it can have an elliptical cross-section.

In the embodiment shown in FIGS. 1 to 3 the geometry and the arrangement of the various parts of the radiating element 1 are such that the polarizers 5 and 9 are oriented in the same fashion, with their respective faces parallel to each other. This relative disposition of the polarizers 5 and 9 produces circular polarization in the same sense for both bands.

To produce circular polarization in opposite senses the polarizers 5 and 9 are oriented at 90° to each other.

Thus the radiating element 1 of the present invention provides four different circular polarization configurations, according to the relative disposition of the polarizers 5 and 9: right/right, right/left, left/right and left/left.

FIG. 2 is a diagrammatic perspective view of the radiating element shown in FIG. 1 seen from a different angle such that the mutual orientation of the various components is apparent.

Thus the radiating element 1 consists of first and second coaxial circuits with independent ports: the first circuit is made up of the excitation port 2, the feeder waveguide 3, the matching transformer 4 and the polarizer 5 and operates in the higher band (30 GHz), and the second circuit is made up of the excitation port 7, the ridged feeder waveguide 6, the matching transformer 8 and the polarizer 5 and operates in the lower band (20 GHz).

The FIG. 3 side view shows again the relative disposition of the various parts of the radiating element, and in particular the relative disposition of the polarizers 5 and 9.

Most of the polarizer 5 is contained within the polarizer 9, from which it projects only slightly along the axis Z. However, in different embodiments, the 30 GHz polarizer 5 can be entirely inside or entirely outside the 20 GHz polarizer 9.

The feeder waveguides 3 and 6 open into the respective polarizers 5 and 9 via the respective matching transformers 4 and 8.

The radiating element 1 is therefore able to operate in two different frequency bands, or to be more precise in two independently accessible sub-bands, one of which is used to transmit (higher sub-band) and the other of which is used to receive (lower sub-band).

This particular geometry of the radiating element 1 also produces circularly polarized electromagnetic waves.

Figure 4:
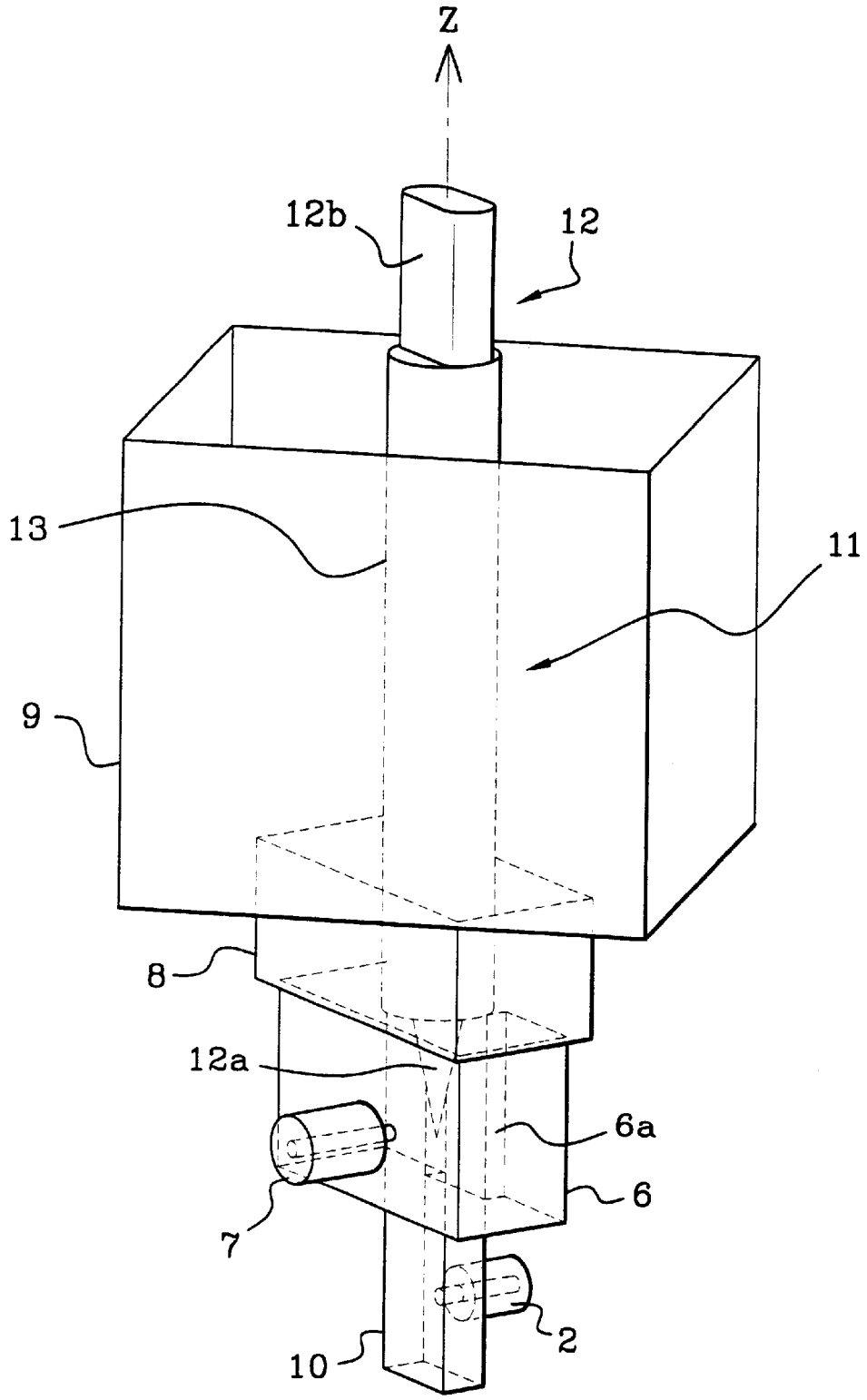
FIG. 4 is a diagrammatic perspective view of a second embodiment of a radiating element according to the invention.

FIG. 4 is a diagrammatic perspective view of a second embodiment of a radiating element 1 according to the invention.

Parts of the radiating element 1 identical to those of the first embodiment shown in FIGS. 1 to 3 are identified by the same reference numbers.

Thus FIG. 4 shows the entire lower band (20 GHz) part of the radiating element 1, including:

the excitation port 7, the ridged feeder waveguide 6, the matching transformer 8 (here with no ridge), and the polarizer 9.

Apart from the absence of the ridge on the matching transformer 8, the differences compared to the first embodiment of the radiating element 1 are all in the high-frequency circuit.

The high-frequency element includes a coaxial excitation port 2 identical to that of the embodiment shown in FIGS. 1 to 3 and associated with a first end of a metal feeder waveguide 10 similar to the waveguide 3 shown in the previous figures.

The cross-section of the waveguide 10 is identical to that of the waveguide 3, but the waveguide 10 is shorter than the waveguide 3 in the direction parallel to the axis Z. The waveguide 10 is accommodated inside the waveguide 6, in line with the ridge 6*a,* in the same manner as that in which the waveguide 3 is accommodated in FIGS. 1 to 3.

The waveguide 10 is interrupted substantially in line with the junction between the waveguide 6 and the matching transformer 8, although any other configuration is feasible. At this location the waveguide 10 is coupled in a manner that is known in the art to a microwave fiber 11 aligned with the waveguide 10.

The microwave fiber 11 is a dielectric waveguide whose axis coincides with the axis Z and which propagates only the H11 hybrid mode (fundamental mode).

Like an optical fiber, the microwave fiber 11 has a solid cylindrical core 12 surrounded by a hollow tubular covering 13. The core 12 and the covering 13 can be a tight fit one inside the other, for example, or a sliding fit and fastened together by gluing them together.

The microwave fiber is ideally made from a "stepped index" dielectric material in a manner that is known in the art. The covering 13 has a relatively high index (not less than 10, for example) to ensure good confinement of the H11 hybrid mode. The index of the core 12 is ideally slightly higher than that of the covering 13.

The materials that can be used are, for example: synthetic sapphire, beryllium oxide, alumina, etc.

The waveguide 10 and the microwave fiber 11 are coupled by the core 12 which has at the end near the excitation port 2 an extension 12*a* penetrating inside the waveguide 10. The extension 12*a* is substantially conical in shape and widens in the upward direction along the axis Z as shown in this figure.

To dispense with the need for a polarizer for the higher frequencies, the microwave fiber 11 advantageously has a geometry that generates circular polarization by generating two orthogonal H11 modes.

To this end the core 12 of the microwave fiber 11 is extended out of the covering 13 on the side opposite the first extension 12*a* to form a second extension 12*b* which has an elliptical cross-section.

In contrast to the shape of the part of the core 12 which is surrounded by the covering 13, the particular ellipsoidal shape of the radiating part 12*b* of the core 12 of the fiber 11, with the major axis parallel to the axis Z, provides a simple way to generate circular polarization without requiring additional components.

As in the first embodiment shown in FIGS. 1 to 3, the part of the radiating element 1 operating in the higher band is disposed coaxially inside the hollow metal part operating in the lower band.

Thus the feeder waveguide 10 and the microwave fiber 11 pass through the ridged feeder waveguide 6, the matching transformer 8 and the polarizer 9.

The invention is not limited to the embodiments described with reference to FIGS. 1 to 4, and other geometries or arrangements of the various components, in particular of the feeder waveguides 3, 6 and 10, the polarizers 5 and 9 and the fiber 11, intended to generate circularly polarized waves in the coaxial radiating element 1, are feasible.

Whatever geometry is adopted, the invention provides a dual band radiating element that is compact, able to generate circular polarization without additional circuits, has an independent port for each frequency sub-band and provides an operating frequency ratio in the range from 1.22 to 2.

The above type of radiating element is particularly suitable for use at high frequencies, such as those of the Ka band, for example.

What is claimed is:

1. A microwave radiating element including first and second means for conveying electromagnetic waves in respective first and second frequency bands, the first means including a hollow metal waveguide adapted to receive the second means coaxially, and the second means including a hollow metal waveguide, wherein the waveguides of the first and second means each terminate in a polarizer and the polarizers are interleaved one within the other.

2. A radiating element according to claim 1, wherein the second means include a waveguide which has a dielectric material core and a dielectric material covering.

3. A radiating element according to claim 2, wherein the dielectric waveguide is a microwave fiber adapted to propagate only the H11 hybrid mode.

4. A radiating element according to claim 2, wherein the geometry of the dielectric waveguide is such that the polarization of the electromagnetic waves is circular.

5. A radiating element according to claim 4, wherein the core of the dielectric waveguide has an extension outside the covering which has an elliptical, rectangular or ellipsoidal cross-section.

6. A radiating element according to claim 1, wherein the geometry of the polarizers is such that the polarization of the electromagnetic waves is circular.

7. A radiating element according to claim 6, wherein the polarizers have a rectangular or elliptical cross-section.

* * * * *